US006363895B1

(12) United States Patent
Butzmann et al.

(10) Patent No.: US 6,363,895 B1
(45) Date of Patent: Apr. 2, 2002

(54) DEVICE FOR CONTROLLING A REGULATOR

(75) Inventors: Stefan Butzmann, Hagen; Joachim Melbert, Deisenhofen, both of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/762,204

(22) PCT Filed: Jul. 5, 1999

(86) PCT No.: PCT/DE99/02085

§ 371 Date: Feb. 23, 2001

§ 102(e) Date: Feb. 23, 2001

(87) PCT Pub. No.: WO00/09867

PCT Pub. Date: Feb. 24, 2000

(30) Foreign Application Priority Data

Aug. 13, 1998 (DE) ..... 198 36 779

(51) Int. Cl.[7] ..... F01L 9/04; F02D 41/20; H01F 7/18

(52) U.S. Cl. ..... 123/90.11; 251/129.01; 251/129.1; 251/129.15; 251/129.16; 361/156

(58) Field of Search ..... 123/90.11; 251/129.01, 251/129.1, 129.15, 129.16; 361/156

(56) References Cited

U.S. PATENT DOCUMENTS 3,741,176 A * 6/1973 Schmidt et al. ..... 123/90.12
3,794,002 A * 2/1974 Wessel ..... 123/90.11
4,794,890 A * 1/1989 Richeson, Jr. ..... 123/90.11
4,972,810 A * 11/1990 Kawamura ..... 123/90.11
5,124,598 A * 6/1992 Kawamura ..... 310/30

FOREIGN PATENT DOCUMENTS

| | | | |
|---|---|---|---|
| DE | 3702680 | A1 | 10/1987 |
| DE | 37 34 415 | A1 | 4/1989 |
| DE | 38 44 193 | A1 | 7/1990 |
| DE | 44 13 240 | A1 | 10/1995 |
| DE | 44 34 684 | A1 | 4/1996 |
| DE | 195 26 683 | A1 | 1/1997 |
| DE | 197 01 471 | A1 | 7/1998 |
| DE | 197 06 247 | A1 | 8/1998 |
| EP | 0 425 169 | A2 | 5/1991 |
| EP | 0 662 697 | A1 | 7/1995 |
| EP | 0 727 566 | A2 | 8/1996 |
| FR | 2 735 591 | | 12/1996 |

* cited by examiner

*Primary Examiner*—Weilun Lo
(74) *Attorney, Agent, or Firm*—Morrison & Foerster, LLP

(57) ABSTRACT

An actuator comprises a gas exchange valve and an electromagnetic actuating drive, having at least one electromagnet which has a coil, having an armature, whose armature plate can move between a first bearing surface on the electromagnet and a second bearing surface. A device for controlling the actuator comprises a power output stage provided for driving the coil. The power output stage has an electrical energy store which is charged by the coil in a predetermined operating state. The control unit controls the power output stage in an operating state of rapid energization when a predetermined condition is met indicating the striking of the armature plate on the first bearing surface or an imminent fallback of the armature plate to a rest position, the energy stored in the electrical energy store being fed to the coil in the operating state of rapid energization.

10 Claims, 8 Drawing Sheets

| BZ1 | T1 | T2 | T3 |
|---|---|---|---|
| RZ | OFF | OFF | OFF |
| NB | ON | ON | OFF |
| FL | ON | OFF | OFF |
| SSR | OFF | OFF | OFF |
| SB | OFF | ON | ON |

| BZ2 | T1' | T2' | T3' |
|---|---|---|---|
| RZ | OFF | OFF | OFF |
| NB | ON | ON | OFF |
| FL | ON | OFF | OFF |
| SSR | OFF | OFF | OFF |
| SB | OFF | ON | ON |

I_HE
I_F
I=H
I_AV1
I_N
t0
t1
t2
t3
t4
t7
t10
t14
t

UGST1
HI
LO
t0
t1
t2
t3
t4
t5
t6
t7
t

UGST2
HI
LO
t0
t1
t2
t3
t4
t5
t6
t7
t

UGST3
HI
LO
t0
t10
t

UC
UC3
UC2
UC1*
UC1
t0
t3
t5
t7
t10
t11
t12
t14
t15
t17
t18
t19
t20
t

DEVICE FOR CONTROLLING A REGULATOR

FIELD OF THE INVENTION

The invention relates to a device for controlling an actuator, in particular, for controlling an internal combustion engine.

BACKGROUND OF THE INVENTION

A known actuator (DE 195 26 683 A1) has an actuating element, designed as a gas exchange valve, and an actuating drive. The actuating drive has two electromagnets between which, in each case counter to the force of a restoring means, an armature plate can be moved by switching off the coil current at the holding electromagnets and switching on the coil current at the capturing electromagnet. The coil current of the respective capturing electromagnet is regulated to a predetermined capture value, to be precise during a predetermined period of time which is dimensioned such that the armature plate strikes a bearing surface on the capturing electromagnet within the period of time. The coil current of the capturing electromagnet is subsequently regulated to a holding value.

The force acting on the armature plate essentially depends on the position of the armature plate and the excitation of the coil of the respective capturing electromagnet. The excitation of the coil depends, in turn, on the current through the coil. The gradient of the current rise of the current through the coil is given by the voltage drop across the coil.

Motor vehicles usually have a voltage supply which makes a predetermined operating voltage available to the electrical loads of the motor vehicle. At the customary operating voltages of from 12 to a maximum of 42 volts, an undesirable fallback of the armature plate to a rest position can thus occur. Likewise, if appropriate, the point in time of "gas exchange valve open" or "gas exchange valve closed" cannot be set sufficiently accurately.

DE 197 01 471 A1 discloses an apparatus for driving an electromagnetic load, with a capacitor which is discharged in each case at the beginning of load driving. This leads to a high current rise in the electromagnetic load.

Furthermore, DE 44 13 240 A1 discloses an apparatus for driving an electromagnetic load which comprises a half-bridge and an energy-storing element arranged between the half-bridge and a voltage source.

SUMMARY OF THE INVENTION

In one embodiment of the invention there is a device for controlling an actuator which is simple and ensures certain and reliable operation of the actuator.

BRIEF DESCRIPTION OF THE DRAWINGS

Exemplary embodiments of the invention are explained in more detail with reference to the schematic drawing, in which.

Elements having the same construction and function are provided with the same reference symbols throughout the figures.

DETAILED DESCRIPTION OF THE INVENTION

Figure 1:
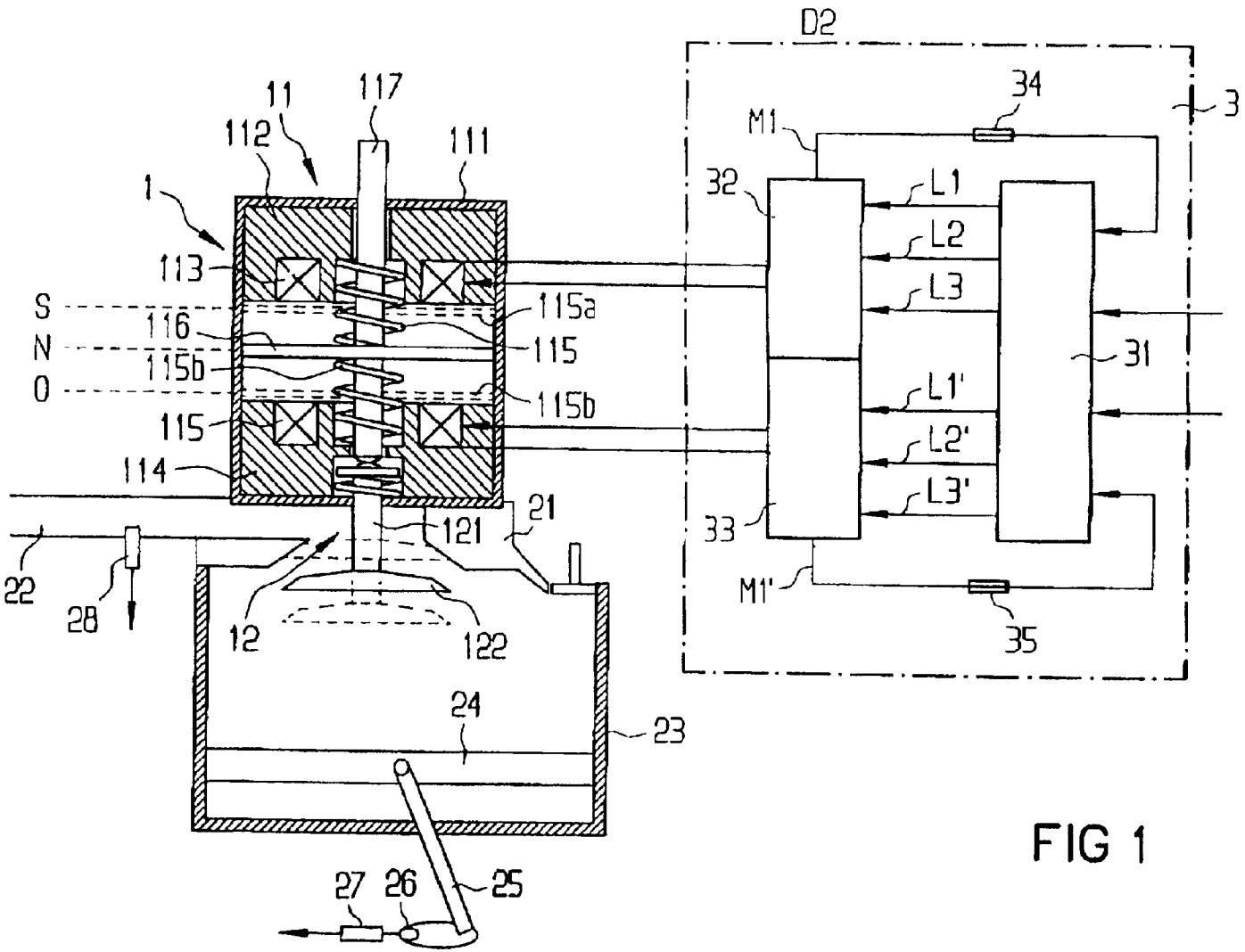
FIG. 1 shows an arrangement of an actuator and a control device in an internal combustion engine.

An actuator 1 (FIG. 1) comprises an actuating drive 11 and an actuating element 12, which is preferably designed as a gas exchange valve and has a stem 121 and a disk 122. The actuating drive 11 has a housing 111, in which a first and a second electromagnet are arranged. The first electromagnet has a first core 112, in which a first coil 113 is embedded in an annular groove. The second electromagnet has a second core 114, in which a second coil 115 is embedded in a further annular groove. An armature is provided, whose armature plate 116 is arranged in the housing 111 in a manner allowing it to move between a first bearing surface 115*a* of the first electromagnet and a second bearing surface 115*b* of the second electromagnet. The armature furthermore comprises an armature stem 117, which is guided through cutouts in the first and second cores 112, 114 and can be mechanically coupled to the stem 121 of the actuating element 12. A first restoring means 118*a* and a second restoring means 118*b* prestress the armature plate 116 into a predetermined rest position N. The actuator 1 is rigidly connected to a cylinder head 21. The cylinder head 21 is assigned an intake duct 22 and a cylinder 23 with a piston 24. The piston 24 is coupled to a crankshaft 26 via a connecting rod 25.

A control device 3 is provided, which acquires signals from sensors and/or acquires signals from a superordinate control device (not illustrated) for engine operating functions and generates actuating signals, depending on which the first and second coils 113, 115 of the actuator 1 are controlled. The sensors assigned to the control device 3 are designed as a first current measuring device 34, which detects an actual value I_AV1 of the current through the first coil, or a second current measuring device 35, which detects an actual value I_AV2 of the current through the second coil 115. In addition to the sensors mentioned there may also be still further sensors.

The control device furthermore comprises a control unit 31 and a first power output stage 32 and a second power output stage 33. Depending on control commands from the superordinate control device and depending on the actual values I_AV1, I_AV2 of the current through the first and second coils 113, 115, the control unit 31 generates control signals for the control lines L1, L2, L3, via which the control unit 31 is electrically conductively connected to the first output stage 32, and control signals for the control lines L1', L2', L3', via which the control unit 31 is electrically conductively connected to the second output stage 33. The first and second power output stages 32, 33 differ merely by the fact that the first power output stage 32 is provided for driving the first coil 113 and the second power output stage is provided for driving the second coil 115. The circuit arrangement and method of operation of their components is equivalent.

Figure 2A:
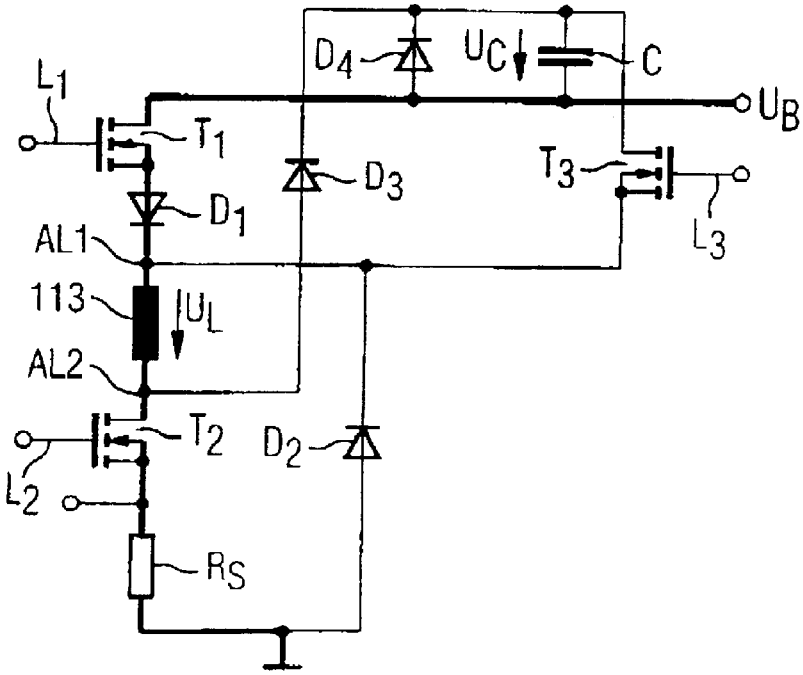
FIG. 2*a* shows a power output stage of the control device in an operating state of normal energization.
Figure 2B:
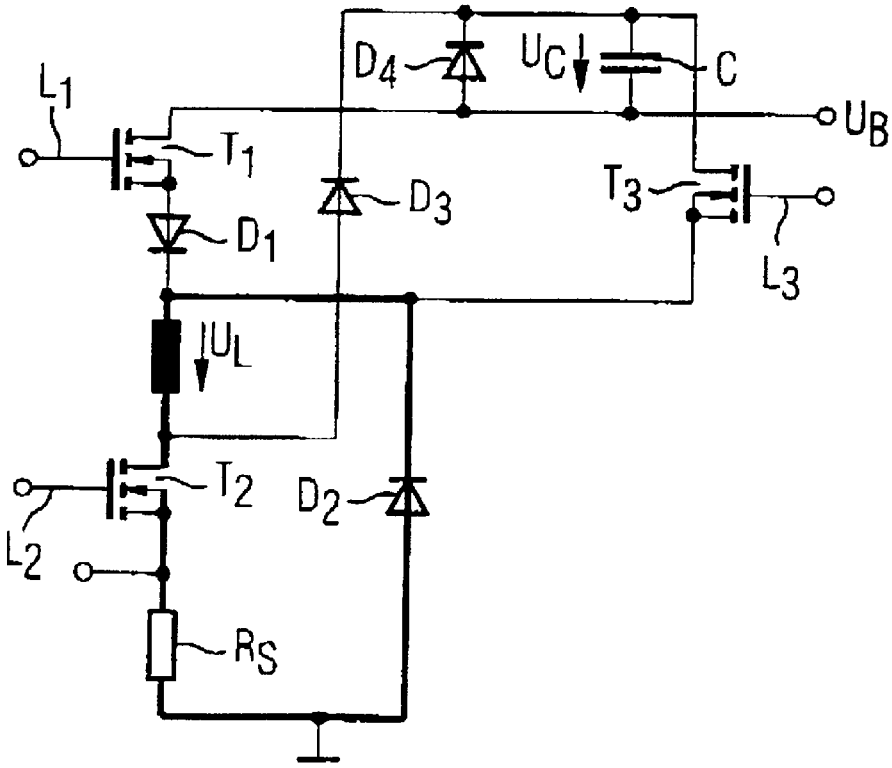
FIG. 2*b* shows the power output stage in the operating state of freewheeling.
Figure 2C:
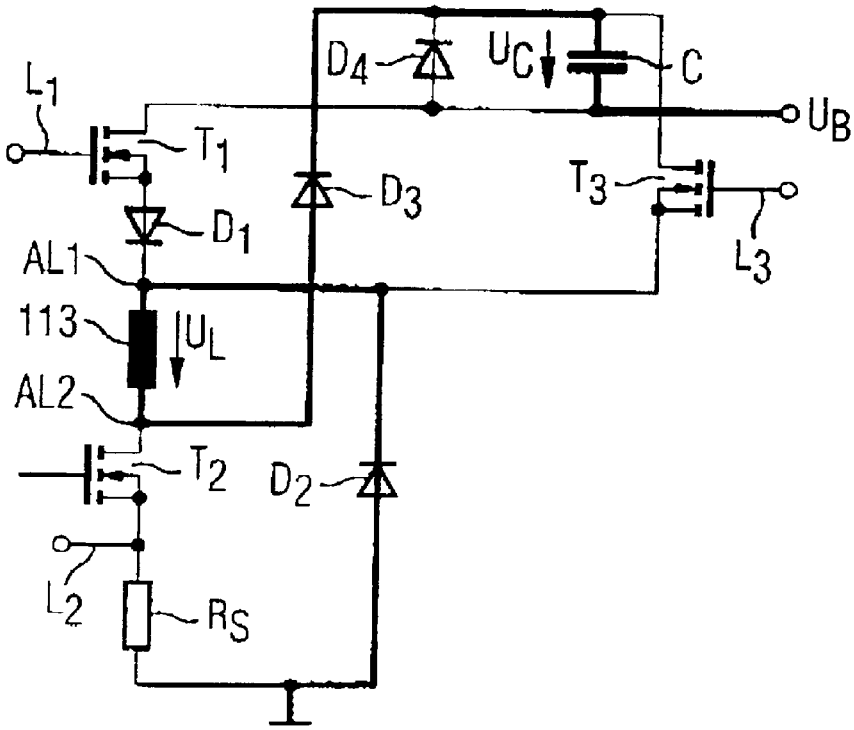
FIG. 2*c* shows the power output stage in the operating state of rapid current reduction.
Figure 2D:
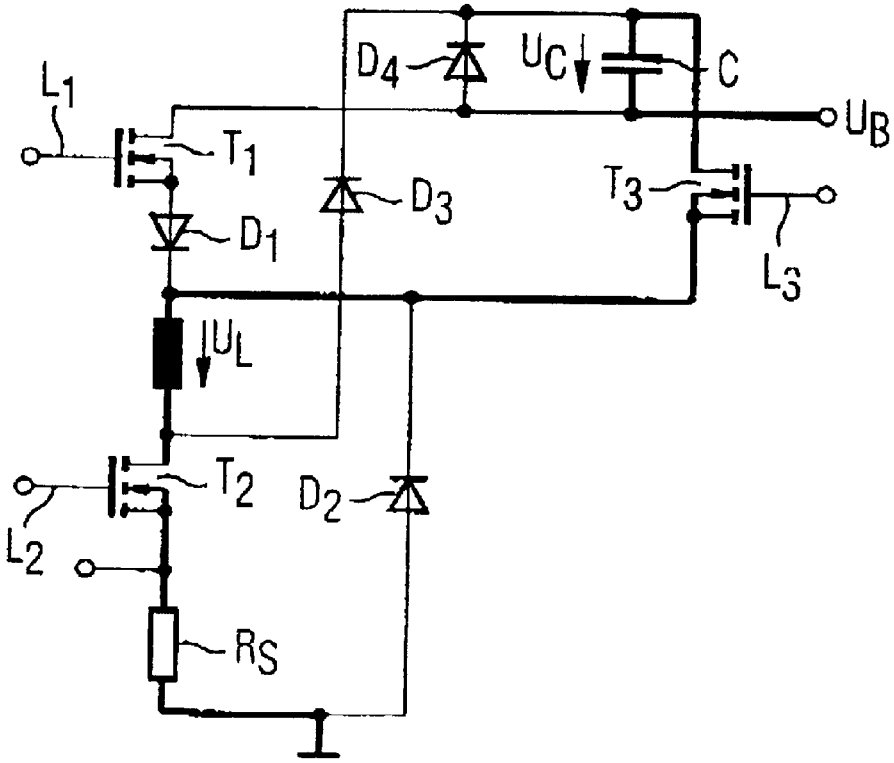
FIG. 2*d* shows the power output stage in the operating state of rapid energization.

The first power output stage 32 is described below by way of example. The first power output stage 32 (FIG. 2*a*) has a first transistor T1, whose gate terminal is electrically conductively connected to the control line L1, a second transistor T2, whose gate terminal is electrically conductively connected to the control line L2, and a third transistor T3, whose gate terminal is electrically conductively connected to a control line L3. The first power output stage 32 furthermore comprises diodes D1, D3, D4, a freewheeling diode D2, an electrical energy store designed as a capacitor C, and a resistor, which is provided as a measuring resistor for the current measuring device 34. The first power output stage can be controlled into five different operating states BZ1 which are each characterized by the respective switching state of the transistors T1, T2, T3. If a high voltage potential is present at the gate terminals of the transistors T1, T2, T3, which are preferably designed as MOS transistors, then the respective transistor T1, T2, T3 is in the on state (ON) from its drain terminal toward the source terminal. By contrast, if a low voltage potential is present at the gate terminal of the respective transistor T1, T2, T3, then the transistor is in the off state (OFF) from its drain terminal to its source terminal. The five operating states BZ1 are entered in FIG. 2*e* with the associated switching states of the transistors T1, T2, T3. The five operating states BZ1 are a quiescent state RZ, normal energization NB, freewheeling FL, rapid current reduction SSR and rapid energization SB. The operating states BZ1 of the power output stage 32 will be explained in more detail below with reference to FIGS. 2*a* to 2*d*.

In the operating state BZ1 of the quiescent state RZ, the transistors T1, T2, T3 are all in the off state. The actual value I_AV1 of the current through the first coil is zero and the voltage drop $U_L$ across the first coil is likewise.

In the operating state BZ1 of normal energization NB, the transistors T1 and T2 are operated in the on state (ON) and the transistor T3 is operated in the off state (OFF). Current then flows from a voltage source with the potential of the supply voltage $U_B$ through the transistor T1, the diode D1, the terminal AL1 of the first coil 113, through the first coil 113 toward the terminal AL2 of the first coil 113, through the transistor T2 and the resistor R toward a ground terminal, which is at a reference-ground potential. As long as the coil is not operated at saturation, virtually the entire supply voltage $U_B$ is dropped across the first coil 113. The current rises in accordance with the ratio of the voltage drop UL across the first coil 113 and the inductance of the first coil 113.

In the operating state of freewheeling FL, the transistor T2 is operated in the on state (ON), whereas the transistors T1, T3 are operated in the off state (OFF). If, at the instant of the transition to the operating state of freewheeling FL, a current flows from the terminal AL1 through the first coil 113 toward the terminal AL2, then the freewheeling diode D2 is turned on and the current through the first coil 113 decreases in a manner dependent on the losses in the coil 113, in the transistor T2, the resistor R and the freewheeling diode D2. The voltage drop $U_L$ across the first coil 113 is then given by the forward voltages of the freewheeling diode and of the transistor T2 and the voltage drop across the resistor R (in total 2 volts, for example).

In an operating state BZ1 of rapid current reduction SSR (FIG. 2*c*) of the first power output stage 32, the transistors T1, T2, and T3 are operated in the off state. If, in the event of the transition to the operating state BZ1 of rapid current reduction SSR, a current flows through the first coil 113, then the freewheeling diode D2 and the diode D3 are turned on. The current then flows from the reference-ground potential via the freewheeling diode D2 toward the terminal AL1 of the first coil 113 and then through the first coil 113 toward the terminal AL2. From there, the current flows via the diode D3 toward the capacitor C and charges the latter. The current through the first coil decreases significantly more rapidly in the operating state of rapid current reduction SSR than in the operating state BZ1 of freewheeling FL, since the negative supply voltage $U_B$ reduced by the voltage drop $U_C$ across the capacitor C and the forward voltages of the freewheeling diode D2 and of the diode D3 is dropped across the first coil 113. In the operating state of rapid current reduction SSR, the first coil 113 and the capacitor C form a first resonant circuit.

In the operating state of rapid energization SB (FIG. 2*d*), the first transistor T1 is operated in the off state (OFF) and the transistors T2 and T3 are operated in the on state (ON). Current flows from the voltage source via the capacitor C, which is discharged in the process, the transistor T3 toward the terminal AL1 of the first coil, through the first coil toward the terminal AL2 of the first coil 113, through the transistor T2 and the resistor R to the reference-ground potential. In the operating state of rapid energization SB, the voltage drop $U_L$ across the first coil 113 is equal to the sum of the supply voltage $U_B$ and the voltage drop $U_C$ across the capacitor C reduced by the forward voltages of the transistor T2 and T3 and the voltage drop across the resistor R.

The voltage drop $U_L$ across the first coil 113 is then about 80 V, for example, given a supply voltage $U_V$ of about 42 V. The rise of the current through the first coil 113 is then approximately twice as high as when merely the supply voltage $U_B$ is dropped across the first coil 113.

A diode D4 is connected in parallel with the capacitor C, and this ensures that the voltage potential at the drain terminal of the transistor T3 does not fall below the supply voltage $U_B$ by more than the forward voltage of the diode D4.

Figures 2E, 2F, 3:
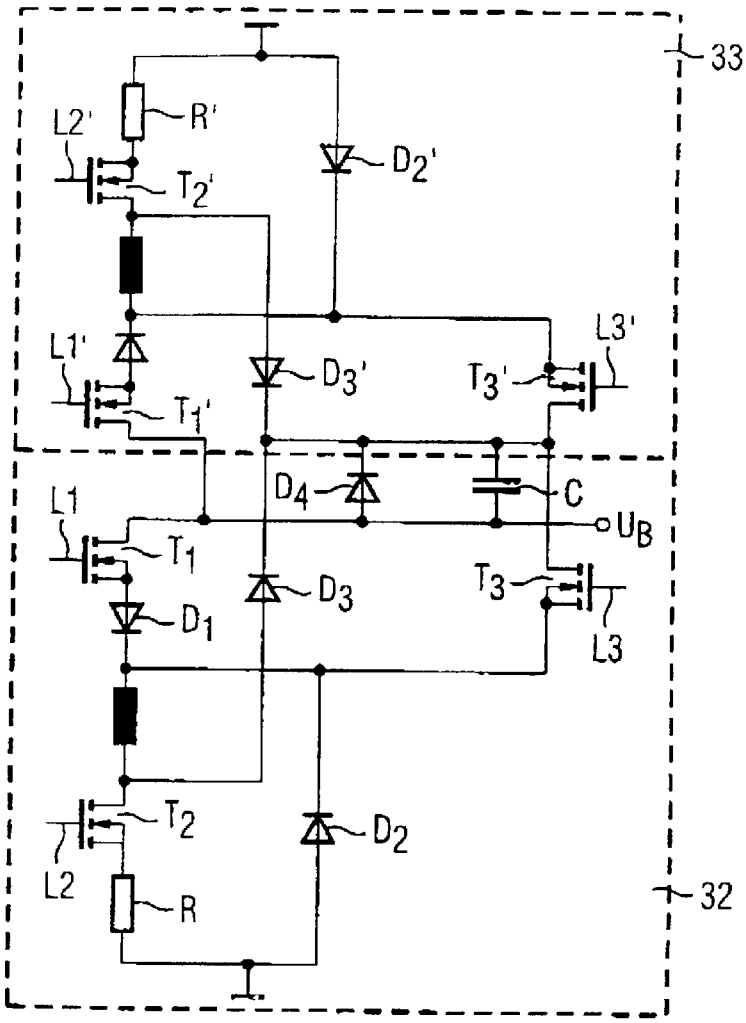
FIG. 2*e* shows a table of the operating states of a first power output stage.
FIG. 2*f* shows a table of the operating states of a second power output stage.
FIG. 3 shows the first power output stage and a second power output stage.

FIG. 3 shows the first and second power output stages 32, 33 in an embodiment in which both power output stages 32, 33 are assigned a common capacitor C. This embodiment has the advantage that just one capacitor is provided, as a result of which the power output stages overall are cost-effective, and the capacitor C can be charged in an operating state Z1 of the first power output stage 32 of rapid current reduction SSR, and can subsequently be discharged again in an operating stage BZ2 of rapid energization SB of the second power output stage 34. This is likewise possible in a converse manner. The reference symbols of the elements of the second power output stage 33 which correspond to the first power output stage 32 are in each case provided with a "'".

Figure 4:
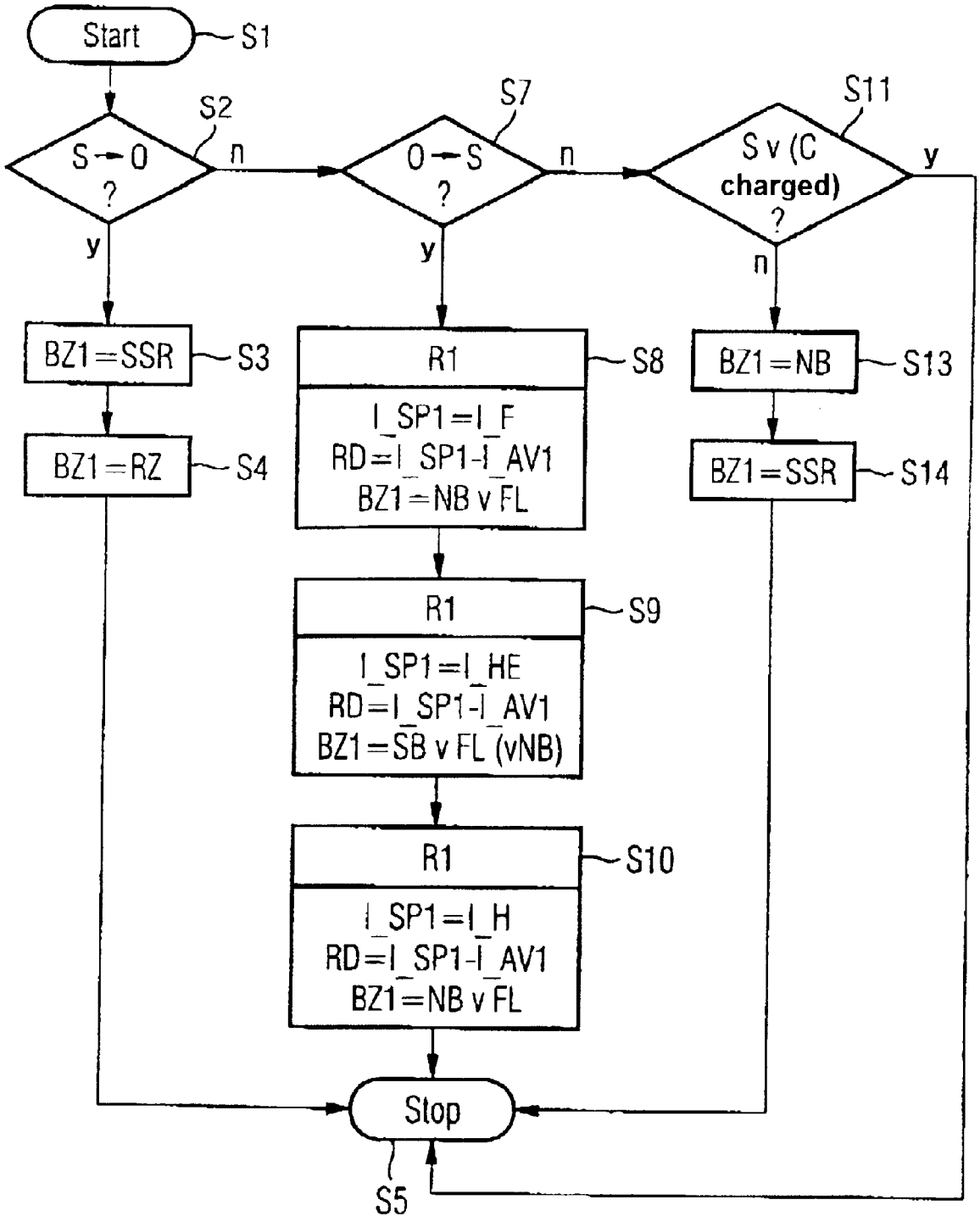
FIG. 4 shows a flow diagram for controlling the first coil.

FIG. 4 illustrates a flow diagram of a first program which is processed in the control unit 31. The program is started in a step S1. The present desired position of the armature plate 116 is read in, this being predetermined by the superordinate control device. In a step S2, a check is made to determine whether the desired position of the armature plate 116 has changed from the closed position S to the open position O since the last calling of the first program. If this is the case, then the first power output stage 32 is controlled into the operating state BZ1 of rapid current reduction SSR in a step S3. The first power output stage 32 changes over to the operating state BZ1 of the quiescent state RZ as soon as the current through the first coil 113 becomes zero. The first program is then ended in step S5.

If the condition of step S2 is not met, then in a step S7 a check is made to determine whether there has been a transition in the desired position of the armature plate 116 from the open position O to the closed position S since the last calling of the first program. If this is the case, then a first regulator R1 is activated in a step S8. The regulated quantity of the first regulator R1 is the current through the first coil 113. A capture value I_F is assigned to a desired value I_SP1 of the current through the first coil 113. A regulation difference RD is calculated from the difference between the desired value I_SP1 and the actual value I_AV1 of the current through the first coil 113. The first regulator R1 is preferably designed as a two-point regulator. The first regulator R1 controls the first output stage 32 into the operating state BZ1 either of normal energization NB or of freewheeling FL, depending on the regulation difference RD. The regulator R1 remains activated until a predetermined condition is met indicating the striking of the armature plate 116 on the first bearing surface 115*a*. The predetermined condition may be, for example, that the armature plate has reached or exceeds a predetermined position. In this case, this predetermined position is chosen such that it is very near the closed position S.

As soon as the predetermined condition is met, the processing is continued in a step S9, in which the first regulator is activated again, the desired value I_SP1 of the current through the first coil 113 being an increased holding value I_HE. In step S9, depending on the regulation difference RD, the first regulator R1 controls the first power output stage 32 either into the operating state BZ1 of rapid energization SB or into the operating state BZ1 of freewheeling FL or, if the capacitor C is discharged, into the operating state BZ1 of normal energization NB. Since the increased holding value I_HE is preferably greater than the capture value I_F, in step S9 the first regulator controls the first power output stage 32 firstly into the operating state of rapid energization SB, until the actual value I_AV1 of the current through the first coil is greater than the increased holding value I_HE, and/or into the operating state of normal energization as soon as the capacitor C is discharged, to be precise until the actual value I_AV1 of the current through the first coil is greater than the increased holding value I_HE.

At the instant of the activation of the first regulator R1 in step S9, the actual position of the armature plate 116 is very near or at the closed position S. For certain and reliable operation of the actuator, it must be ensured that the armature plate bears reliably on the first bearing surface and neither bounces off nor falls back to the rest position N before the closed position S has been reached. The controlling of the operating state BZ1 of rapid energization SB makes it possible to set the actual value I_AV1 of the current through the first coil 113 very rapidly to the increased holding value I_HE. This has the advantage that the first regulator R1, in step S9, can be activated immediately before the armature plate 116 strikes the first bearing surface 115*a*, with the result that the speed of the armature plate is no longer significantly increased and the noise of the armature plate striking the first bearing surface 115*a* is thus low. After a predetermined period of time has elapsed, which is preferably determined by experiments, the processing is continued in a step S10.

In step S10, the first regulator R1 is activated, the desired value I_SP1 of the current through the first coil 113 is the holding value I_H and the regulator controls the first power output stage 32, depending on the regulation difference RD, either into the state of the operating state BZ1 of normal energization NB or freewheeling FL until a transition takes place in the desired position of the armature plate from the closed position S to the open position O. The processing of the program is subsequently ended in step S5.

If the condition of step S7 is not met, then the processing is continued in a step S11, in which a check is made to determine whether the desired position of the armature plate 116 is the closed position S or whether the capacitor C is charged to a predetermined value. Checking whether the capacitor C is charged to the predetermined value can be effected in a particularly simple manner by evaluation of a counter which is incremented each time a step S13 is processed, and is reset in step S8. It is advantageous if a sensor is provided which detects the voltage drop $U_C$ across the capacitor C, and the charge of the capacitor C is determined from the voltage drop $U_C$ detected. If the condition of step S11 is met, then the first regulator R1 remains active, as in step S10, if the desired position of the armature plate 116 is the closed position S, and the first program is ended in step S11. If the condition of step S11 is not met, however, then the processing is continued in a step S13, in which the first power output stage 32 is controlled into an operating state BZ1 of normal energization NB, to be precise either for a fixedly predetermined period of time or until the actual value I_AV1 of the current through the first coil 113 has reached a predetermined value. Afterward, in a step S14, the power output stage 32 is controlled in the operating state BZ1 of rapid current reduction SSR. Thus, the capacitor C can simply be charged while the first coil 113 is not energized for capturing or holding the armature plate 116. The processing of the program is then ended in step S5.

The first program is called cyclically, to be precise either at predetermined time intervals or after a predetermined change in the crankshaft angle. While the desired position of the armature plate 116 is the open position O, the first power output stage 32 is thus controlled into the operating state BZ1 of rapid current reduction SSR once in step S3, and into the operating state BZ1 of rapid current reduction a number of times in step S14, and the capacitor C is thus charged to the predetermined value within a predetermined period of time.

It is advantageous if, in step S8, the first coil 113 is controlled into the operating state of freewheeling as soon as the energy necessary for reaching the closed position has been fed to the armature plate. The first coil 113 is then in the state of freewheeling FL if the predetermined condition is met, indicating the striking of the armature plate 116 on the first bearing surface 115*a*.

Figure 5:
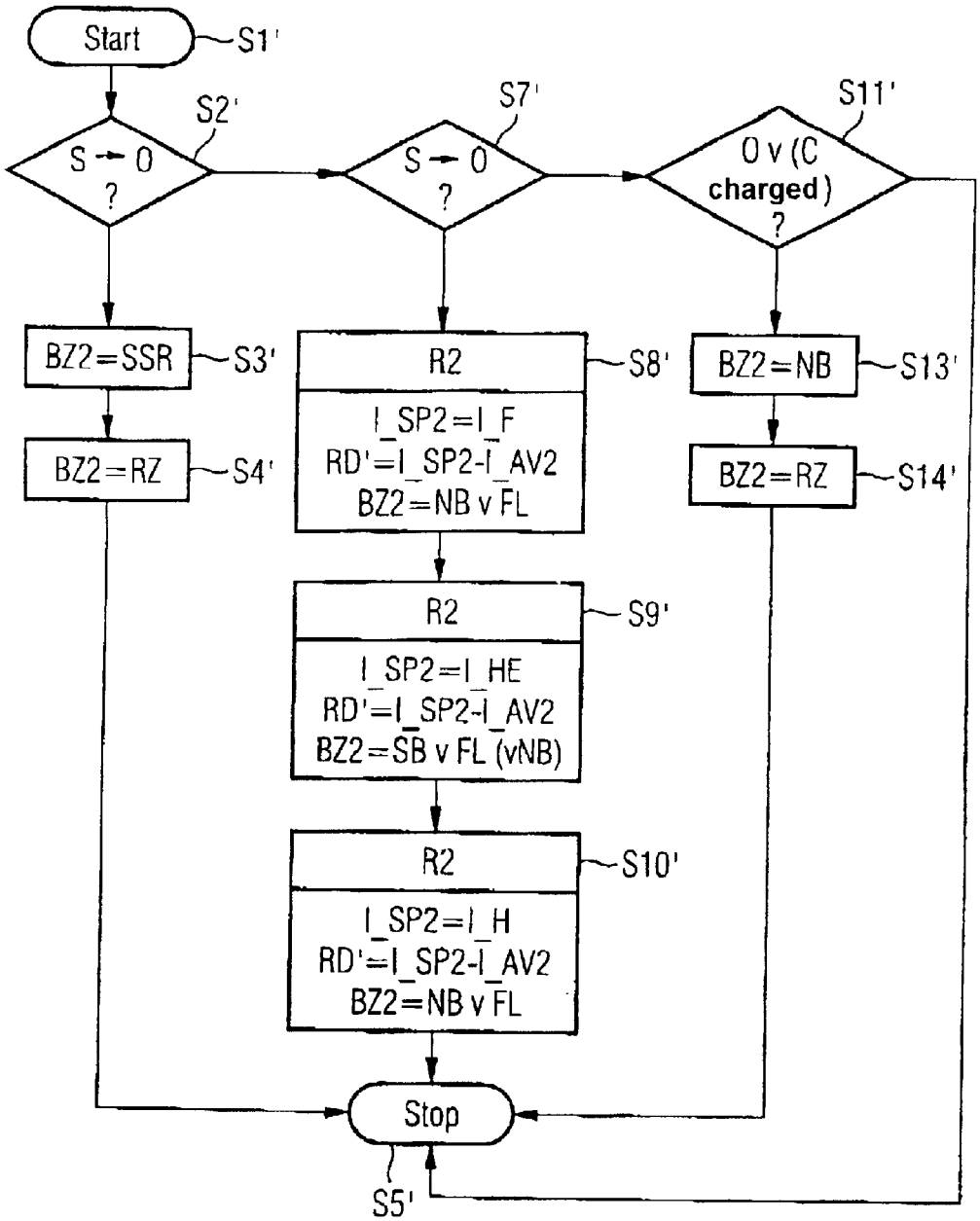
FIG. 5 shows a flow diagram of a diagram for controlling the second coil.
Figures 6A, 6B:
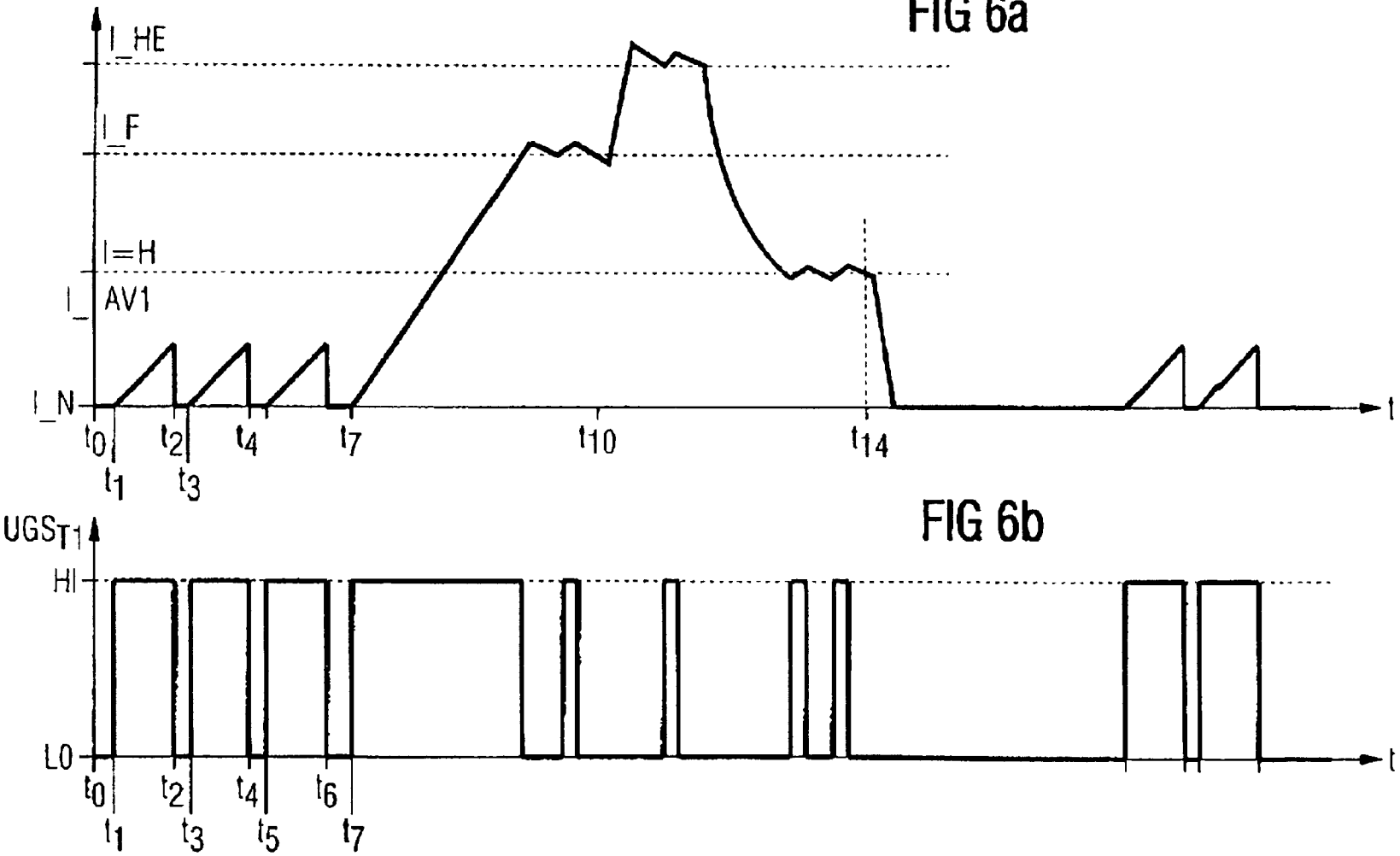
FIGS. 6*a*–6*e* show signal profiles of the current and of the voltages.
Figures 6C, 6D, 6E:
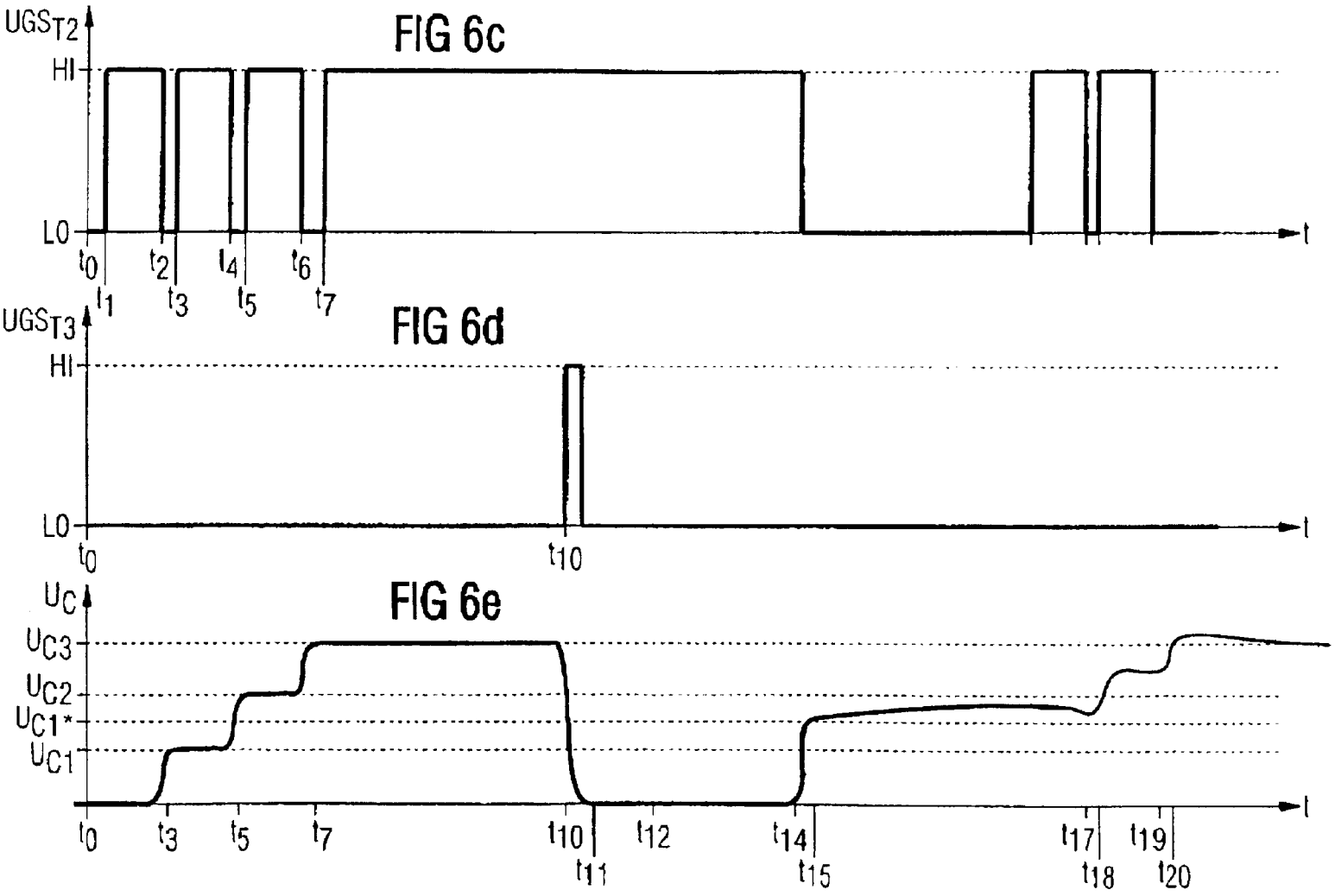

A flow diagram of a second program for controlling the second coil 115 is illustrated in FIG. 5, which program is processed in the control unit 31. The second program has the same structure as the first program (FIG. 4). Only the differences from the first program are described below.

In a step S2', a check is made to determine whether the desired position of the armature plate 116 has changed from the open position O to the closed position S since the last calling of the first program. If this is the case, then the second power output stage is controlled into the operating state BZ2 of rapid current reduction SSR in a step S3'. The second power output stage 34 changes over to the operating state BZ2 of the quiescent state RZ as soon as the current through the second coil 115 becomes zero.

If the condition of step S2' is not met, then a check is made in a step S7' to determine whether there has been a transition in the desired position of the armature plate 116 from the closed position S to the open position O since the last calling of the second program.

In a step S8', a second regulator R2 is activated, whose regulated quantity is the current through the second coil 115. A regulation difference RD' is calculated from the difference between the desired value I_SP2 and the actual value I_AV2 of the current through the second coil 115. The second regulator R2 is preferably designed as a two-point regulator. The second regulator R2 controls the second output stage 33 in a manner depending on the regulation difference RD' in a corresponding way to how the first regulator R1 controls the first output stage.

The regulator R2 remains activated in step S8' until a predetermined condition is met, indicating the striking of the armature plate 116 on the second bearing surface 115*b*.

At the instant of the activation of the second regulator R2 in step S9', the actual position of the armature plate 116 is very near or at the open position O. For certain and reliable operation of the actuator, it must be ensured that the armature plate bears reliably on the second bearing surface and neither bounces off nor falls back into the rest position N before the open position O is reached.

If the condition of step S7' is not met, then the processing is continued in a step S11', in which a check is made to determine whether the desired position of the armature plate 116 is the open position O or whether the capacitor C is charged to a predetermined value.

If the condition of step S11' is not met, then the processing is continued in a step S13' in which the second power output stage 33 is controlled into an operating state BZ1 of normal energization NB, to be precise either for the fixedly predetermined period of time or until the actual value I_AV2 of the current through the second coil 115 has reached a predetermined value. Afterward, in a step S14', the second power output stage 33 is controlled into the operating state BZ2 of rapid current reduction SSR.

In FIGS. 6*a* to 6*e*, signal profiles are plotted against time t. The time profile of the actual value I_AV1 of the current through the first coil 113 is plotted in FIG. 6*a*. The time profile of the voltage difference $UGS_{T1}$ between the gate and source terminals of the transistor T1 is plotted in FIG. 6*b*. The time profile of the voltage difference $UGS_{T2}$ between the gate terminal and the source terminal of the transistor T2 is plotted in FIG. 6*c*. The time profile of the voltage difference $UGS_{T3}$ between the gate terminal and the source terminal at the transistor T3 is plotted in FIG. 6*d*.

If the voltage difference $UGS_{T1}$ has a high level HI, the transistor T1 is in the on state (T1=ON) . If the voltage difference $UGS_{T1}$ at the transistor T1 has a low level LO, the transistor turns off, that is to say is in the off state (T1=OFF). Likewise, the transistor T2 turns on if the voltage difference $UGS_{T2}$ has a high level HI (T2=ON) and the transistor T2 turns off if the voltage difference $UGS_{T2}$ has a low level LO (T2=OFF). If the voltage difference $UGS_{T3}$ between the gate terminal and the source terminal of the transistor T3 has a high level, then the transistor T3 is in the on state (T3=ON). If the voltage difference $UGS_{T3}$ between the gate terminal and the source terminal of the transistor T3 has a low level, then the transistor T3 turns off, that is to say it is in the off state (T3=OFF).

At an instant to, the desired position of the armature plate 116 is the open position O. The actual value I_AV1 of the current through the coil is zero. At an intant $t_1$, the first power output stage 32 is controlled into an operating state of normal energization NB, to be precise until the instant $t_2$.

From the instant $t_2$, the first power output stage 32 is controlled into the operating state BZ1 of rapid current reduction SSR. Until the instant $t_3$ the voltage drop $U_C$ across the capacitor C has increased to a value $U_{C1}$. Starting from the instant $t_3$, the first power output stage 32 is then again controlled into the operating state BZ1 of normal energization NB, to be precise until an instant $t_4$. Starting from the instant $t_5$, the first power output stage 32 is then again controlled into the operating state BZ1 of rapid current reduction SSR, with the result that the voltage drop $U_C$ across the capacitor C has the value $U_{C2}$ at the instant $t_5$.

Starting from the instant $t_5$, the first power output stage 32 is then again controlled into the operating state BZ1 of normal energization, to be precise until an instant $t_6$, in which it is then again controlled into the operating state BZ1 of rapid current reduction SSR until the instant $t_7$. Starting from the instant $t_7$, the desired value I_SP1 of the current through the first coil is the capture value I_F and the first regulator R1 is activated as in step S8 (FIG. 4), to be precise until an instant $t_{10}$ the position of the armature plate 116 has reached a predetermined value near or directly on the first bearing surface 115*a*. Starting from the instant $t_{10}$, the first power output stage 32 is controlled into the operating state of rapid energization SB in order very rapidly to bring the actual value I_AV1 of the current through the first coil to the new desired value I_SP1, to be precise of the increased holding value I_HE, and thus, if appropriate to prevent an imminent fallback of the armature into the rest position N or severe bouncing of the armature plate 116. In this case, the capacitor C is discharged and the voltage drop across the capacitor $U_C$ decreases accordingly to the value zero at the instant $t_{11}$. The first coil 113 is then energized with the increased holding current I_HE until the instant $t_{12}$. Starting from the instant $t_{12}$, the holding value I_H is predetermined as the desired value I_SP1 of the current through the first coil, and starting from the instant $t_{14}$, the open position O is predetermined as the desired position. Accordingly, the first power output stage 32 is controlled into the operating state BZ1 of rapid current reduction SSR starting from the instant $t_{14}$. In this case, the energy stored in the first coil 113 is fed to the capacitor C, whose voltage drop is increased to a value $U_{C1}$* until an instant $t_{15}$. Between the instant $t_{17}$ and $t_{18}$ and the instants $t_{19}$, $t_{20}$, the capacitor C is again charged until the capacitor has a voltage drop having the value $U_{C3}$ at the instant $t_{20}$. The capacitor then has the predetermined charge and is charged further again only when the charge of the capacitor C has decreased.

What is claimed is:

1. A device for controlling an actuator which comprises a gas exchange valve and an electromagnetic actuating drive, having one electromagnet which has a coil, having an armature, whose armature plate can move between a first bearing surface on the electromagnet and a second bearing surface, the device comprising a power output stage provided for driving the coil, wherein the power out stage has an electrical energy store which is charged by the coil in a predetermined operating state, and wherein a control unit controls the power output stage into an operating state of rapid energization when a predetermined second condition is met indicating the striking of the armature plate or the first bearing surface or an imminent fallback of the armature plate from the first bearing surface to a rest position, the energy stored in the electrical energy store being fed to the coil in the operating state of rapid energization.

2. The device as claimed in claim 1, wherein the power output stage is charged in an operating state of rapid current reduction.

3. The device as claimed in claim 2, wherein the power output stage is controlled into the operating state of rapid current reduction within a period of time in which the desired position of the armature plate is on the second bearing surface.

4. The device as claimed in claim 1, further comprising the control unit, which controls the power output stage after a change of the desired position of the armature plate toward the second bearing surface into the operating state of rapid current reduction from a holding value to a zero value of the current through the coil, the electrical energy store being simultaneously charged.

5. The device as claimed in claim 4, wherein the control unit controls the power output stage alternately into an operating state of normal energization and of rapid current reduction during the movement of the armature plate away from the first bearing surface, or the bearing of the armature plate on the second bearing surface, to be precise until a predetermined first condition is met, which is characteristic of a predetermined charge of the electrical energy store.

6. The device as claimed in claim 1, wherein the power output stage has a first resonant circuit, which is a series circuit comprising a freewheeling diode, the coil, a diode and the electrical energy store in an order of enumeration from a reference-earth potential through to a terminal of a voltage source.

7. The device as claimed in claim 6, wherein the power output stage has a second resonant circuit, which is a series circuit comprising a first switching means, the coil, a second switching means and the electrical energy store in an order of enumeration from a reference-ground potential through to the voltage source.

8. The device as claimed in claim 1, wherein the actuating drive comprises a second electromagnet having a second coil and is provided with a second power output stage.

9. The device as claimed in claim 8, wherein a common electrical energy store is provided for both the power output stages.

10. The device as claimed in claim 9 wherein the electrical energy store is a capacitor.

* * * * *